United States Patent [19]

Doye et al.

[11] Patent Number: 5,066,249

[45] Date of Patent: Nov. 19, 1991

[54] COAXIAL SUBMINIATURE CONNECTOR

[75] Inventors: Dennis L. Doye, Mount Joy; Michael R. Sneed, Harrisburg, both of Pa.

[73] Assignee: AMP Incorporated, Harrisburg, Pa.

[21] Appl. No.: 629,733

[22] Filed: Dec. 18, 1990

[51] Int. Cl.[5] ..... H01R 17/18

[52] U.S. Cl. ..... 439/585; 439/741

[58] Field of Search ..... 439/578–585, 439/675, 741, 751, 745, 746, 873, 871, 872

[56] References Cited

U.S. PATENT DOCUMENTS

| | | | |
|---|---|---|---|
| 3,323,098 | 3/1965 | O'Keefe et al. | 339/177 |
| 3,366,920 | 11/1965 | Laudig et al. | 339/177 |
| 3,757,278 | 9/1973 | Schumacher | 339/177 R |
| 3,923,367 | 12/1975 | Carter | 439/585 |
| 4,360,244 | 11/1982 | Forney, Jr. et al. | 439/581 |
| 4,964,814 | 10/1990 | Zengler et al. | 439/581 |

FOREIGN PATENT DOCUMENTS

| | | | |
|---|---|---|---|
| 0213312 | 3/1987 | European Pat. Off. | 439/873 |
| 2202694 | 9/1988 | United Kingdom | 439/585 |

*Primary Examiner*—David L. Pirlot
*Attorney, Agent, or Firm*—Gerald K. Kita

[57] ABSTRACT

A coaxial connector (1) comprises, a conductive electrical contact (2) for connection with a signal conductor (7) of an electrical cable (6), a conductive shell (3) concentrically encircling the contact (2) for connection with a conductive shield (9) of the cable (6), an insulation part (4) concentrically between the contacts (2) and the shell (3), and projections in the contact (2) and in the shell (3) formed by bulged indentations instead of by cutting the contact (2) and the shell (3).

4 Claims, 2 Drawing Sheets

COAXIAL SUBMINIATURE CONNECTOR

FIELD OF THE INVENTION

The invention relates to an electrical coaxial connector and, more particularly, to a coaxial connector for insertion in a conductive receptacle.

BACKGROUND OF THE INVENTION

A coaxial connector disclosed in U.S. Pat. No. 3,366,920, is constructed with portholes through which a tool enters to apply crimping forces. The portholes provide air gaps for atmospheric air that has a different dielectric constant than any of those of solid dielectric materials used to construct the connector. Impedance compensation is provided, after the crimping forces have been applied, by assembling a bushing having insulative ribs that extend into the portholes to replace atmospheric air with solid dielectric material.

A coaxial connector known from U.S. Pat. No. 3,757,278, comprises, a conductive electrical contact for connection with a signal conductor of an electrical cable, a conductive shell concentrically encircling the contact for connection with a conductive shield of the cable, and insulation concentrically between the contact and the shell. The contact is assembled by movement into a rear of the shell, and registers against a rear of a dielectric sleeve, and thereby is restrained from movement.

A coaxial connector disclosed in U.S. Pat. No. 3,323,098 pertains to a flange or annular barb which operates to lock a center contact member against movement forwardly in an insulating part.

SUMMARY OF THE INVENTION

An advantage of the invention resides in a coaxial connector that includes projections to prevent forward movement of an electrical contact with respect to a dielectric body, wherein the projections are continuous with an exterior surface of the electrical contact instead of weakening the contact by being cut from the contact.

A further advantage resides in a coaxial connector in which a conductive contact is shortened from a comparison with the connector of U.S. Pat. No. 3,323,098, by a construction limited to a unitary center contact and a unitary conductive shell held concentrically by two spaced dielectric bodies.

A further advantage of the invention resides in a coaxial connector that comprises, a conductive electrical contact for connection with a signal conductor of an electrical cable, a conductive shell concentrically encircling the contact for connection with a conductive shield of the cable, a dielectric body concentrically between the contact and the shell, the dielectric body having a contact receiving cavity with a rear facing wall, the contact being received in the cavity with a front end of the contact facing the wall, and projections on the exterior of the contact that are continuous with an exterior surface of the contact for engaging a rear end of the dielectric body and preventing the front end of the contact from abutting the rear facing wall.

The invention will now be described, by way of example, from the following detailed description, taken in conjunction with the accompanying drawings.

DETAILED DESCRIPTION

Figures 1, 2:
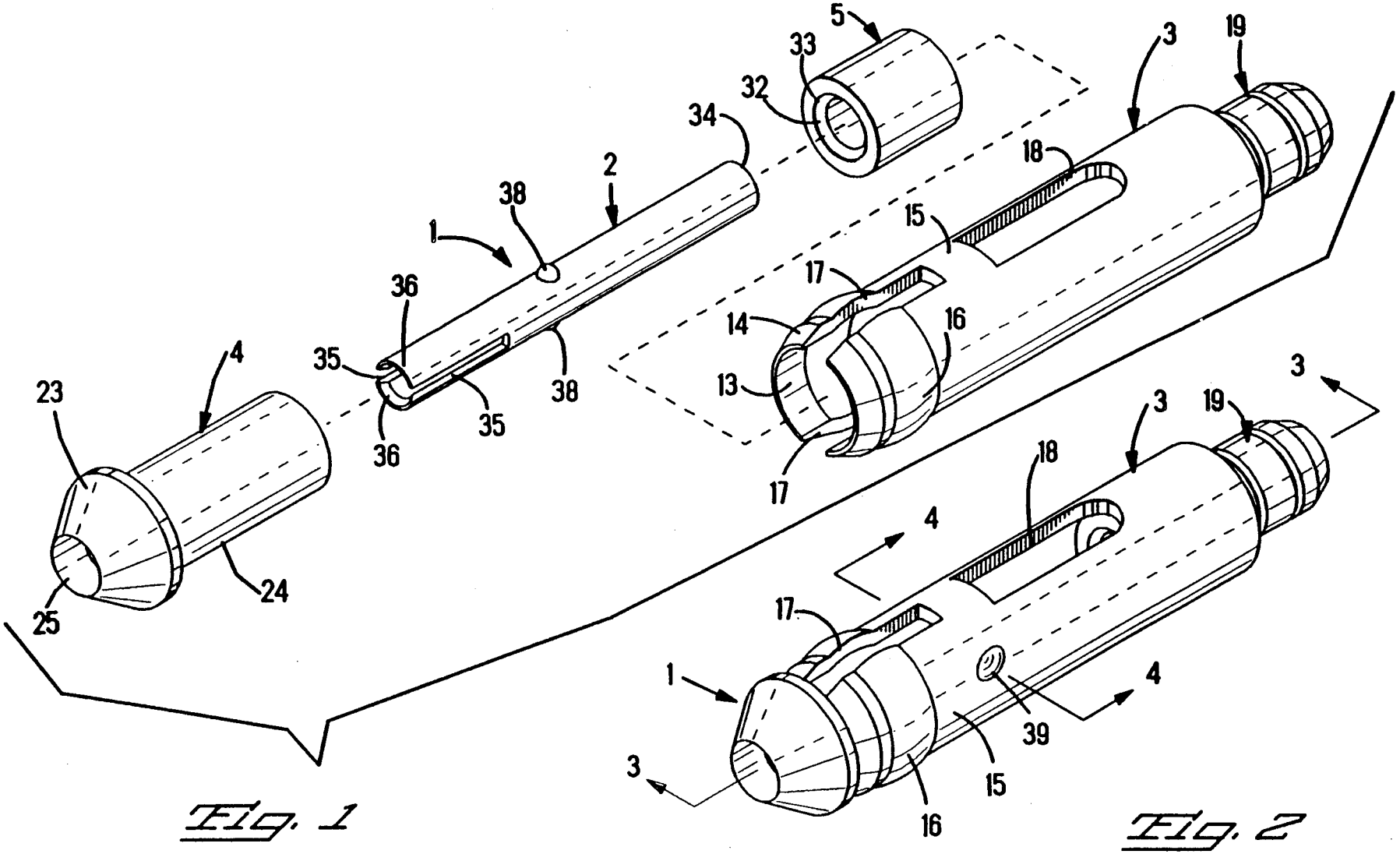
FIGURE 1 is an enlarged perspective view of a coaxial connector with parts illustrated apart from one another.
FIG. 2 is an enlarged perspective view of an assembled connector as shown in FIG. 1.

With reference to FIG. 1, a coaxial connector 1 comprises a conductive electrical contact 2, a conductive shell 3 concentrically encircling the contact 2 and a two piece dielectric body comprised of insulation parts 4 and 5 extending over the contact 2 concentrically between the contact 2 and the shell 3. The connector 1 is constructed for connection with a coaxial cable 6. The cable 6 includes a conductive signal conductor 7 concentrically encircled by a flexible dielectric 8, in turn, concentrically encircled by a conductive shield 9, in turn, concentrically encircled by an insulative, outer jacket 10. The cable 6 is trimmed to project the signal conductor 7, the dielectric 8 and the shield 9 from the end of the jacket 10.

Figure 3:
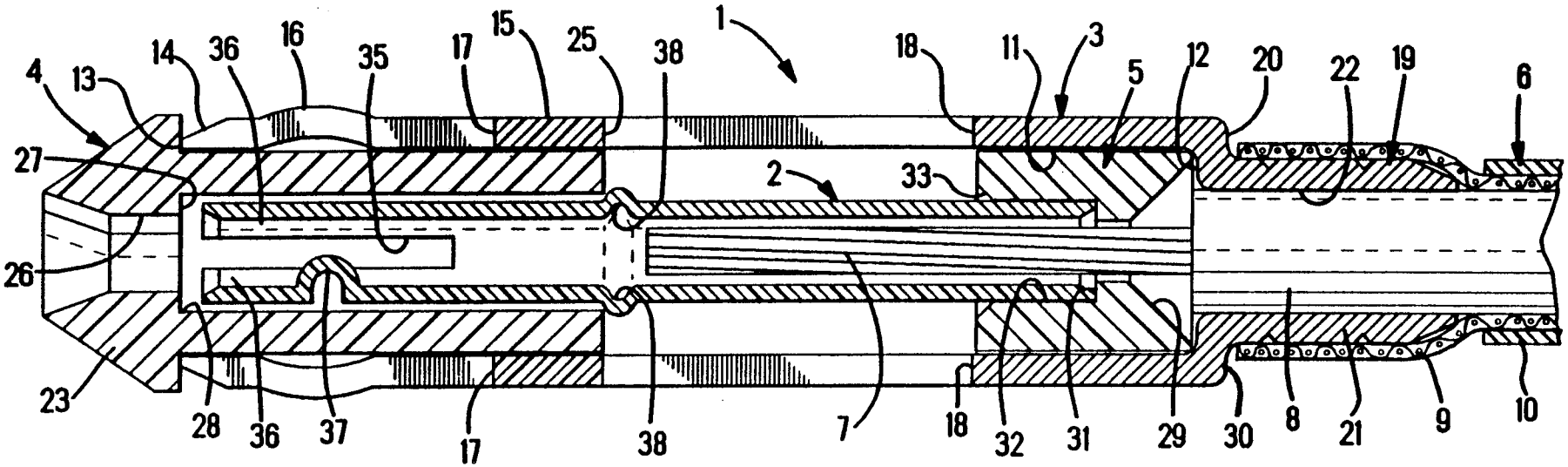
FIG. 3 is a section view taken along a line 3—3 of FIG. 2.

With reference to FIG. 3, the shell 3 is generally cylindrical with a stepped cylindrical interior 11 having at least one forward facing shoulder 12 of ring shape. A thin walled lip 13 on the front end is forward of an exterior, frusto conical nose 14. A cylindrical portion 15 extends rearward from the nose 14 and is radially expanded with a bulbous portion 16 for providing a friction fit inside a socket, not shown. Longitudinal slots 17, communicating with the front end, bifurcate the lip 13 and the bulbous portion 16 to provide spring fingers for biasing the bulbous portions 16 radially outward against the socket. Portholes 18 extend through the shell 3 rearwardly spaced from the slots 17. The portholes provide access for crimping or inwardly compressing the contact 2 radially on the conductor 7, FIG. 3, of the cable 6 that has been inserted into a rear end 19 of the shell, projecting along the interior of the contact 2. The rear end 19 of the shell 3 includes a transverse end wall 20 intersected by a reduced diameter sleeve portion 21 with a hollow interior 22 concentric with the longitudinal, central axis of the shell 3.

With reference to FIGS. 1 and 3, the insulation part 4 is of unitary construction with an enlarged, frustoconical, front portion 23, a span 24 of reduced diameter extending from the front portion 23 to the rear end 25. An internal, contact receiving cavity 26 extends axially through and has a rear facing shoulder 27 adjacent a rear, enlarged diameter portion 28. Insulation part 5 is unitary and includes a rear facing, flared entry 29 at a rear end 30 of the insulation 4, a front facing shoulder 31 within a contact receiving cavity 32, and a flared opening 33 at the front.

Figure 4:
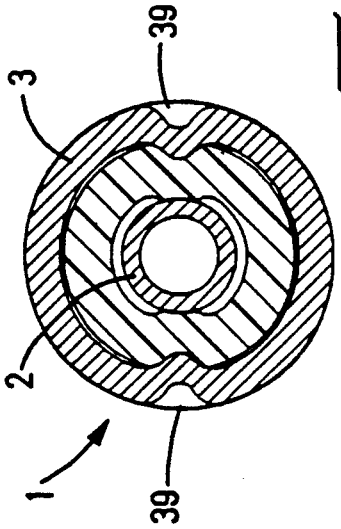
FIG. 4 is a section view taken along a line 4—4 of FIG. 2.

The insulation part 5 is assembled concentrically on a rear end 34 of the contact 2. The insulation part 4 is assembled concentrically over the front end of the contact 2. Longitudinal slots 35 extend through the front end of the contact 2 to provide multiple spring fingers 36. In the insulation part 4, sufficient radial clearance is provided for allowing the spring fingers 36 to expand radially in the cavity 28 when a conductive contact pin, not shown, is inserted into the hollow contact 2. A bulged indentation 37 of the contact 2 projects inside the contact 2 to provide a wiping contact surface against the contact pin. Additional bulged inientations 38 supply projections on the exterior of the contact 2 that register against the end 25 of the insulation part 4 to prevent movement of the contact 2 forwardly with respect to the insulation part 4. The front end of the contact 2 and the spring fingers 36 are held away from the portion 27 of the insulation part 4, so that the spring fingers 36 will not engage the portion 27 and be restrained from radial expansion. The contact 2 and the insulation parts 4 and 5 are inserted into the shell 3 from the front end 13, until the insulation part 5 registers against the portion 12, and the rear of the nose 23 radially overlaps the lip 13 of the shell 3. Thereafter, bulged indentations 39, FIGS. 2 and 4, of the shell 3 are applied to provide inward projections that compress against the insulation part 4, and, in turn, cause the insulation part 4 to compress radially inward against the contact 2 to retain all the parts together, and restrained from relative movement.

An advantage of the invention resides in the coaxial connector 1 that includes projections 37 and 38 and 39 that function as described, wherein the projections 37 and 38 and 39 are continuous with an exterior surface of the electrical contact 2 instead of weakening the contact 2 by being cut from the contact 2.

A further advantage resides in the coaxial connector 1 in which the contact 2 is shortened from a comparison with the connector of U.S. Pat. No. 3,323,098, by a construction limited to a unitary center contact 2 and a unitary conductive shell 3 held concentrically by two spaced dielectric parts 4 and 5.

We claim:

1. A coaxial connector comprising; a conductive electrical contact for connection with a signal conductor of an electrical cable, a conductive shell concentrically encircling the contact for connection with a conductive shield of the cable, a dielectric body encircled by a forward portion of the shell and concentrically between the contact and the shell, the dielectric body having a contact receiving cavity with a rear facing wall and a rear end inside the shell, the contact being received in the cavity with a front end of the contact facing the wall, projections on the exterior of the contact that are continuous with an exterior surface of the contact engaging the rear end of the dielectric body and preventing the front end of the contact from abutting the rear facing wall, buldged projections on the inside of the shell formed by indentations in the exterior of the shell radially compressing together the shell and the dielectric body and the contact, and a second dielectric body encircled by the shell and receiving a rear end of the contact, the second dielectric body having a forward facing shoulder at the rear end of the contact.

2. A coaxial connector as recited in claim 1, comprising: a front end of the dielectric body being supported concentrically against an interior of the shell.

3. A coaxial connector as recited in claim 1, comprising: an enlarged portion of the dielectric body overlapping the front of the shell.

4. A coaxial connector as recited in claim 1, comprising: projections formed by bulged indentations for radially compressing the shell and the dielectric body and the contact together.

* * * * *